United States Patent [19]

Doyel

[11] 4,159,788

[45] Jul. 3, 1979

[54] WALL MOUNTED FLUID DISPENSER

[76] Inventor: John S. Doyel, 404 W. 20th St., New York, N.Y. 10011

[21] Appl. No.: 832,731

[22] Filed: Sep. 12, 1977

[51] Int. Cl.[2] ..... B67D 5/60

[52] U.S. Cl. ..... 222/144.5; 222/181; 222/340; 222/510

[58] Field of Search ..... 222/130, 131, 132, 144.5, 222/173, 180, 181, 185, 328, 340, 341, 377, 453, 484, 505, 509, 510, 518, 559; 206/77.1; 220/DIG. 6

[56] References Cited

U.S. PATENT DOCUMENTS

| | | | |
|---|---|---|---|
| 1,866,237 | 7/1932 | Thompson et al. | 222/341 |
| 1,953,200 | 4/1934 | Thomas | 222/509 X |
| 2,473,696 | 6/1949 | Anderson | 222/341 X |
| 2,718,335 | 9/1955 | Shippen | 222/181 X |
| 2,764,324 | 9/1956 | Landreth | 222/518 X |
| 2,772,814 | 12/1956 | Myers | 222/453 X |
| 3,178,059 | 4/1965 | Packwood | 272/181 X |
| 3,688,895 | 9/1972 | Wilson | 206/77.1 X |
| 3,902,637 | 9/1975 | Scheeler | 222/144.5 |
| 4,039,104 | 8/1977 | Mijares, Jr. et al. | 222/181X |

FOREIGN PATENT DOCUMENTS

| | | | |
|---|---|---|---|
| 622451 | 2/1927 | France | 222/510 |
| 401594 | 3/1974 | U.S.S.R. | 220/DIG. 6 |

*Primary Examiner*—Robert J. Spar
*Assistant Examiner*—Fred A. Silverberg
*Attorney, Agent, or Firm*—Cooper, Dunham, Clark, Griffin & Moran

[57] ABSTRACT

A fluid dispenser is disclosed, most of whose parts along with its wall-mounting bracket are of a resilient plastic such as polystyrene and cooperate in such manner as to permit hand assembly. The dispenser comprises a facade member on which a plurality of separate containers for different fluid substances are mounted, and each container is provided with a simplified dispensing valve and operator, composed of snap-fitted parts, for dispensing a premeasured amount of the fluid. The wall mounting bracket is provided with adjustment plates for corner mounting the dispenser on irregular walls, and a top cover fits over the facade member, containers and wall bracket forming a shelf and sealing the fluid in the containers.

7 Claims, 9 Drawing Figures

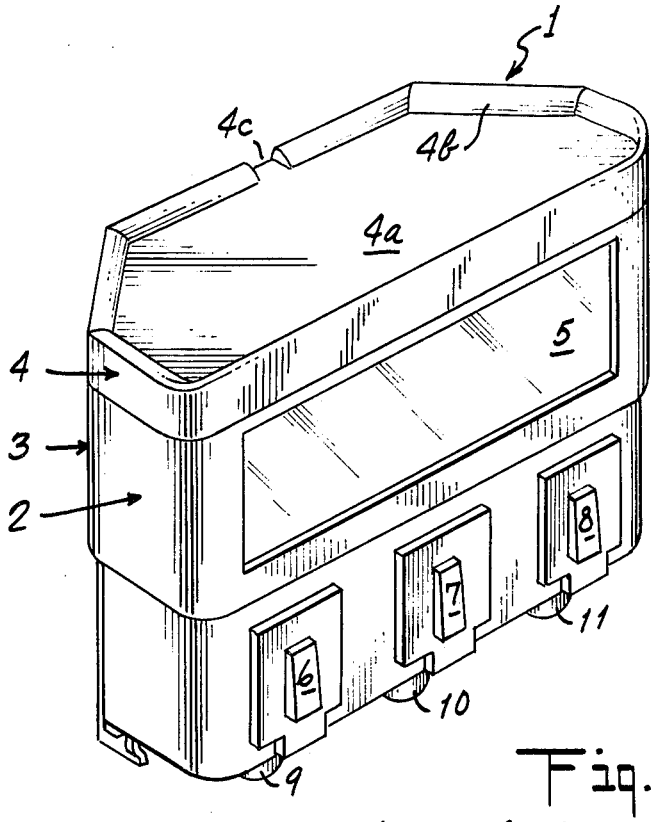
Fig. 1.
Fig. 2.
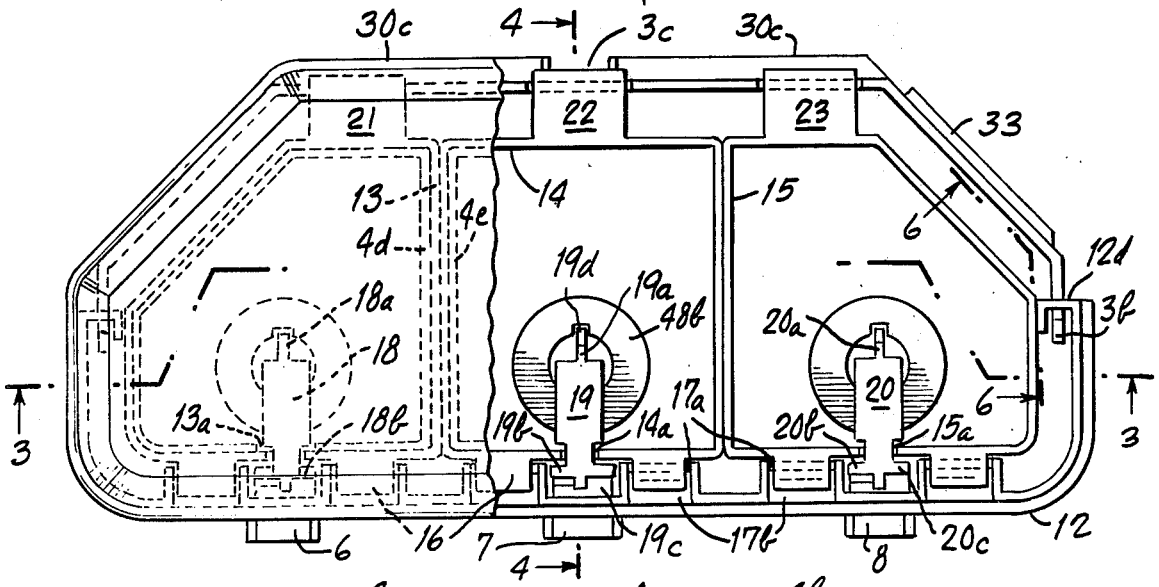
Fig. 3.

Fig. 4.
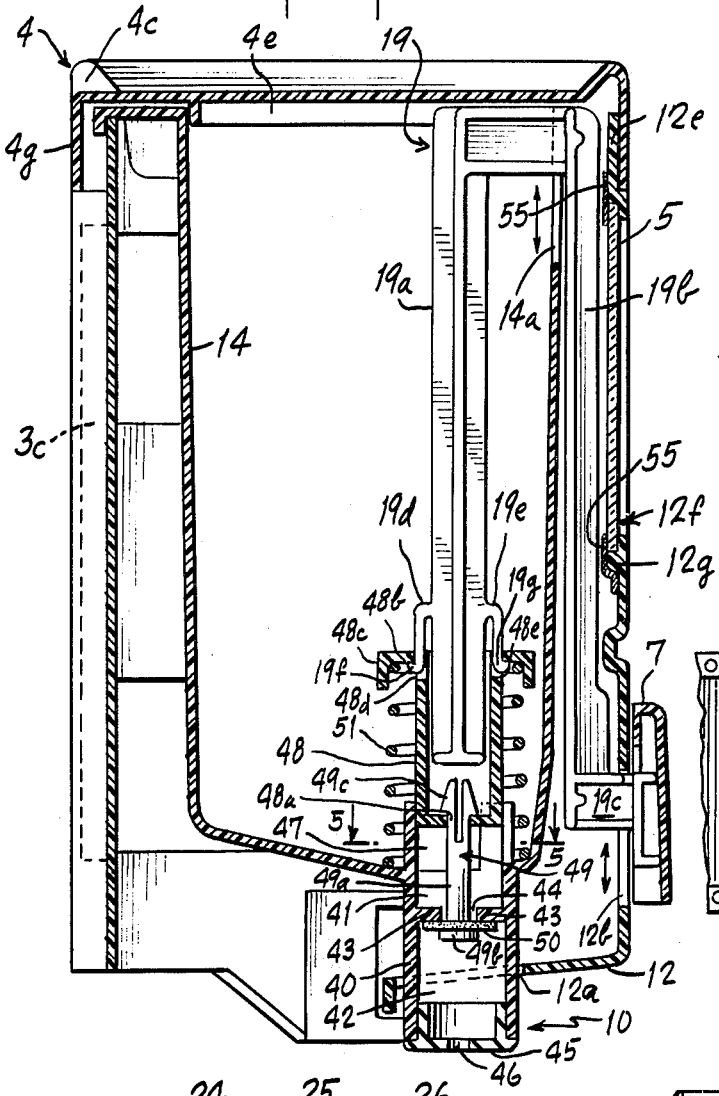
Fig. 5.
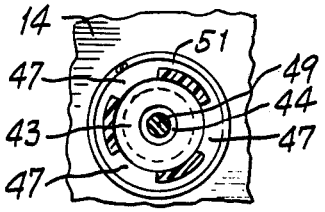
Fig. 6.
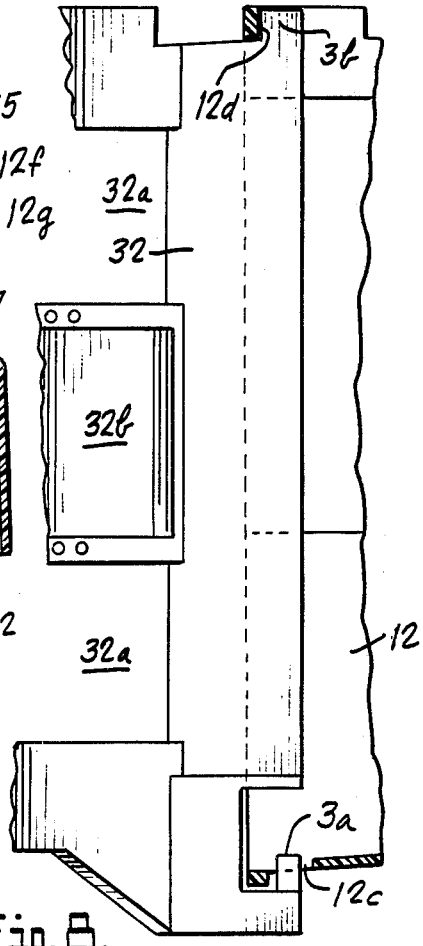
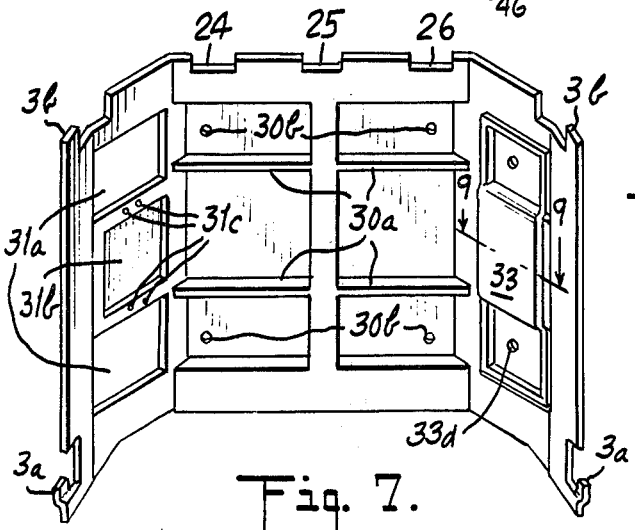
Fig. 7.
Fig. 8.
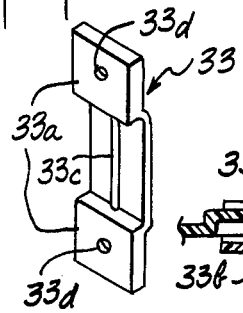
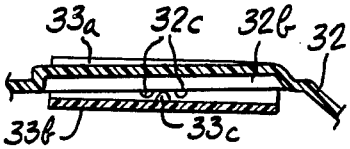
Fig. 9.

WALL MOUNTED FLUID DISPENSER

BACKGROUND OF THE INVENTION

The present invention relates to a fluid dispenser, and more particularly, to a dispenser of the hand-operated wall-mounted type which dispenses one or more liquids or powders successively in premeasured amounts.

Many liquid dispensing devices are known of the type which may be mounted on the wall of a bathroom, lavatory or kitchen and which dispense small premeasured amounts of liquid soap, or the like, stored therein. Such dispensers are usually operated by manually pressing a button or moving a handle to actuate a valve or piston that evacuates a supply of liquid or powder which has been held in a chamber within the dispenser. These dispensers and their operating mechanisms have been characterized in their construction by a number of different parts, requiring time consuming and complicated assembly and disassembly and expensive materials and manufacture.

By way of contrast the present invention provides a liquid dispenser which is constructed almost entirely of plastic and of a minimum number of parts that are easily hand-assembled and disassembled, and which may be wall-mounted on a flat wall or in a corner whose walls are irregularly disposed.

SUMMARY OF THE INVENTION

The dispensing apparatus of the present invention comprises: one or more open-mouth containers for holding different fluids to be dispensed; a facade member, on and behind which the containers are mounted, having a mirror on the front and accommodating manually operable dispensing buttons; valves, in the bottom of each of the containers for controlling the dispensing of premeasured amounts of fluids therefrom, with operating levers each having an arm extending into the interior of the container connected to the valve and an arm extending between the container and the facade member with an extension at its lower end on which the dispensing button is mounted; a wall-mounting bracket, which may be attached to a flat wall or in a corner, on which the facade member and containers are mounted; and a cover or lid which fits over the upper ends of the facade member, containers and wall-mounting bracket and has ribs on its underside which cooperate with the inner peripheral rims of the containers to seal the fluids therein.

All of the parts, most of which are of a resilient plastic, may be interconnected and snap-fitted so as to permit hand-assembly and disassembly of the entire apparatus. The wall-mounting bracket is provided with adjustment plates to facilitate corner mounting on irregular walls and the simplified dispensing valve assembly comprises a spring-loaded piston-like member with a closure valve mounted on its head, which respectively operate in a fluid storage chamber and a dispensing chamber to dispense a premeasured amount of fluid in response to each operating stroke. The container and valve assembly combine to promote fluid agitation and dispensing while minimizing leaks.

BRIEF DESCRIPTION OF THE DRAWINGS

FIG. 1 is a perspective view of an assembled composite dispenser in accordance with the present invention as it appears in its mounted condition.

FIG. 2 is a top view with a portion partially broken away of the dispenser shown in FIG. 1.

FIG. 3 is a front view in section of the upper portion of the dispenser taken along the lines 3—3 in FIG. 2, and showing the cooperation of the cover member and the parts of the dispensing unit.

FIG. 4 is a sectional view taken along the lines 4—4 in FIG. 2, showing the details of the dispensing valve.

FIG. 5 is a sectional view taken along the lines 5—5 in FIG. 4.

FIG. 6 is a view taken along the lines 6—6 in FIG. 2, showing the mounting arrangement between the mounting bracket and the dispenser unit.

FIG. 7 is a view in elevation of the mounting bracket.

FIG. 8 is a perspective view of an auxiliary mounting plate.

FIG. 9 is a sectional view taken along the lines 9—9 in FIG. 7, showing the cooperation of the mounting bracket and the auxiliary mounting plate.

DETAILED DESCRIPTION OF THE INVENTION

An assembled dispenser 1 in accordance with the present invention is shown in FIG. 1. While this dispenser will be found suitable for many applications, which will become apparent upon consideration of the following description, the particular embodiment shown is intended to be mounted on the wall of a bathroom or shower room and to contain one or more fluent materials which may be dispensed in preselected portions therefrom.

The dispenser 1 essentialy comprises a dispensing unit 2 supported on a rear mounting bracket 3 with a removable top cover or lid 4 which sealingly fits over the dispensing unit and mounting bracket. A mirror 5 is provided in the upper front portion of the dispensing unit 2, and a set of dispensing buttons 6, 7 and 8 are disposed beneath the mirror for selecting the particular fluent materials to be dispensed from respective dispensing taps 9, 10 and 11 underneath the unit.

The dispenser shown is adapted to contain and dispense three different fluid substances such as soap, shampoo and hair conditioner, but the number and nature of the substances may be varied as will be understood by those skilled in the art. Also, it is preferred that with the exception of the mirror, and a valve spring and sealing washer to be described, all the parts of the dispenser are constructed of a resilient plastic such as polystyrene.

Referring to FIG. 2, it will be seen that the dispensing unit 2 is composed of a supporting facade member 12, on which the mirror 5 is mounted, and three individual containers 13, 14 and 15 which are juxtaposed behind the facade member 12 and are used to store the substances to be dispensed. Each of the containers at its upper front edge is provided with two hook tabs 16 which may be fitted over cooperating ribs **17*a* and 17*b* at the top of the supporting facade member 12 with the respective dispensing taps 9, 10 and 11 on the bottoms of the three containers, extending through accommodating apertures 12*a* in the underside of the facade member 12 (see FIG. 4). Three U-shaped dispensing levers 18, 19 and 20 which operate the dispensing valves in the respective containers are fitted over the front edges of the containers and accommodated for up and down movement in slots 13*a*, 14*a*, and 15*a*. One arm (18*a*, 19*a*, and 20*a*) of each lever extends into the container for connection to the respective valve and the other arm (18*b*, 19*b***, and 20*b*) extends between the front wall of the container and the facade member 12. Each of the arms, 18*b*, 19*b*, and 30*b*, has an extension, 18*c*, 19*c*, and 20*c* at its lower end which extends through a respective slot 12*b* in the front of the facade member 12 and is respectively fitted with a dispensing button 6, 7 and 8. Accordingly, the facade member 12, the containers 13, 14 and 15, and the dispensing valves and operating means all cooperate to form the integral dispensing unit 2.

Hook tabs 21, 22 and 23 are also provided on the rear upper edges of the three containers for cooperating with appropriate slots 24, 25 and 26 on the rear upper edge of the mounting bracket 3 to assist in mounting the dispensing unit 2 on the bracket. As seen in FIGS. 2 and 6, facade member 12 has slots 12*c* at its rear lower outer edges and hook tabs 12*d* at its rear upper outer edges which respectively cooperate with hanging pins 3*a* and 3*b* on bracket 3 to complete this mounting arrangement.

The top cover or lid 4, as will be seen with reference to FIGS. 1–4, is provided with a flat upper surface 4*a* and a surrounding rim 4*b*, so that it may act as a shelf for various bath articles when the dispenser is mounted on the wall. An opening 4*c* is provided in the rim 4*b* at the rear of the lid 4, which opening cooperates with a drainage track 3*c* (see FIGS. 2 and 4) on the back of the mounting bracket 3 to permit the runoff of shower water or other fluids which may collect on the upper surface of the lid. As shown, particularly in FIGS. 2 and 3, the under side of the lid 4 is provided with three sets of ribs 4*d*, 4*e* and 4*f*. Each of the ribs is in a closed configuration, except for a space to permit the passage of the levers, and is adapted to respectively fit into the upper rims of the three containers so that when the lid 4 is forced down into place over the indented upper edge 12*e* of the facade member 12, the three containers are simultaneously sealed thereby. The rear edge 4*g* of the lid 4 extends over the upper edge of the mounting bracket 3 when the dispensing unit 2 is mounted thereon and engages the upper edges of the drainage track 3*c* (see FIG. 4) thus forming a complete water-tight top closure for the dispenser 1 when completely assembled.

Referring still to FIG. 4, the details of the dispensing valve will now be described. Firstly, it will be seen that a cylindrical body or valve barrel 40 is disposed or molded in the bottom forward portion of each container, the particular container shown in FIG. 4 being central container 14. Valve barrel 40 is divided into an upper chamber and a lower chamber 41 and 42, respectively, by an interior partition 43 having a central aperture 44 therein. The lower end of the barrel 40 is fitted with an end cap 45 having a central capillary opening 46 therein, forming dispensing tap 10, and the upper portion within the container is formed with three longitudinal slots 47 (see FIG. 5). Fitted into the slotted upper portion of barrel 40 is a valve spool member 48 adapted for up and down movement therein.

The lower end of the spool member 48 is provided with a central aperture 48*a* which accommodates the bifurcated end of a valve piece 49. The valve piece 49 comprises a valve shaft 49*a*, which extends through the partition aperture 44 into lower chamber 42, having a head 49*b* on its lower end and the bifurcated upper end 49*c*. The head 49*b* is fitted with a collar 50 in the form of a rubber sealing washer which closes off the aperture 44 when the valve piece 49 is in its uppermost position.

The upper end of the spool member 48 is formed with a flange 48*b*, which extends radially outward and has a downwardly descending shoulder 48*c*, for accommodating the upper end of a compression spring 51. The lower end of the compression spring 51 abuts the bottom of the container 14 and urges the spool member 48 in the upward direction. The lower end of lever arm 19*a* extends into the interior of spool member 48. The upward urging action of the spring 51 on the spool member 48 is opposed both by the engagement of the washer 50 with partition 43 and the engagement of the lower ends of the gripping arms with the lower surfaces of the cutouts which is maintained ultimately by the engagement of the upper surface of extension 19*c* on lever arm 19*b* with the upper edge of the slot 12*d* in the facade member 12.

The mounting bracket 3 as seen in FIG. 7 is composed of a back wall portion 30 and two side wall portions 31 and 32 which may be integrally molded on the opposite sides of the back wall portion. It is suitable for mounting the dispenser either on a flat wall or in a corner. The solid back wall portion may be formed with reinforcing ribs 30*a* and provided with four holes 30*b* at its extremities to permit screw mounting of the bracket to a flat wall. Alternatively, the back wall rear surfaces 30*c* (see FIG. 2) may be used to adhesively attach the bracket to a flat wall. The side wall portions 31, 32 are formed with upper and lower cutouts 31*a*, 32*a* and a central partition 31*b*, 32*b* and are disposed at an angle with respect to the back wall portion such that the planes in which they lie intersect behind the back wall portion substantially at a right angle to facilitate corner mounting of the bracket. To compensate for any lack of plumb when corner-mounting the bracket, matching corner plates 33 such as shown in FIG. 8 are provided. The corner plates 33 comprise two mounting surfaces 33*a* which fit through the apertures 31*a*, 32*a* in the bracket side walls and are connected by partitions 33*b* having axial locating ribs 33*c* which cooperate with sets of locating pips 31*c*, 32*c* on the central partitions 31*b*, 32*b* of the bracket side walls. As seen in FIG. 9 the corner plates may be rotated through small angles, about the locating rib, with respect to the planes of the side walls. As a result, if the bathroom walls forming the corner on which the bracket 3 is to be mounted are not disposed exactly at 90° with each other at the points where the bracket side walls are to be attched, so that the bracket side wall portions will not lie exactly flat against the walls, the bracket can still be securely mounted thereto by means of the corner plates 33. The mounting surfaces 33*a* may be attached to the walls either by screws through holes 33*d* or by adhesive.

The assembling, mounting and operation of the dispenser 1 may be accomplished as follows. The valve spool member 48 for container 14 is connected to the U-shaped lever 19 by inserting the lower end of the interior arm 19*a* into the interior of the member and snap-locking the end portions 19*f*, 19*g* of the resilient gripping arms 19*d*, 19*e* into the cutouts 48*d*, 48*c*. The compression spring 51 is then placed in position at the bottom of the container 14 and the lower end of the spool member 48 is inserted into the upper chamber 41 of the valve barrel 40 with the upper end of the spring 51 engaging the upper flange 48*b*. The spool member 48 is pressed down into the upper chamber 41 against the action of the spring 51, and the bifurcated end 49*c* of the valve piece 49, with the sealing washer 50 mounted on its lower end, may be inserted through the lower chamber 42 in the valve barrel 40, and the aperture 44 in the central partition 43, and snap-locked into the aperture 48*a* in the lower end of the spool member 48. The valve assemblies in the other containers are similarly assembled.

With the valve assemblies in place, all of the containers 13, 14 and 15 may be mounted on the facade member 12 by inserting the lower ends of their valve barrels through the accommodating apertures in its underside and hanging their hook tabs 16 on the cooperating ribs and slots 17*a*, 17*b* at its top, while guiding the lower extensions 18*c*, 19*c* and 20*c* on the outer lever arms 18*b*, 19*b* and 20*b* through the slots 12*b* in the lower front of the facade member 12. The dispensing buttons 6, 7 and 8 are then press fitted down over the ends of the lever arm extensions 18*c*, 19*c* and 20*c*, and all of the parts of the dispensing unit 2 are accordingly secured together.

The mounting bracket 3, as previously noted, may be attached to a flat wall by means of an adhesive on its rear surfaces 30*c* or by the use of screws passed through the four appropriate holes 30*b* provided therein. For corner mounting with regular walls an adhesive may be used on the rear surfaces of the side wall partitions 31*b* or, alternatively, the corner plates 33 may be inserted in place and screws inserted through the appropriate holes 33*d* in the fastening surfaces 33*a*, or adhesive used on these surfaces. For irregular walls the corner plates 33 are inserted in place and appropriately rotated about the locating ribs 33*c* until the fastening surfaces 33*a* are properly oriented with the surfaces of the walls and then attachment is completed by means of an adhesive or screws.

When the mounting bracket 3 is securely fastened to the wall, the dispensing unit 2 may be mounted thereon by hanging the hood tabs 21, 22 and 23 at the rear of the containers 13, 14 and 15 over the slots 24, 25 and 26 in the upper edge of the bracket back wall portion 30 while inserting the lower and upper hanging pins 3*a* and 3*b* on the side wall portions 31, 32 into the lower slots 12*c* and upper hook tabs 12*d* on the facade member 12. The dispenser 1 is thus assembled and mounted ready for use.

To use the dispenser 1, appropriate fluid substances are poured into the containers 13, 14 and 15 to a level not to exceed the level of the lower edges of the slots 13*a*, 14*a* and 15*a* in the top of the containers which accommodate the upward and downward movement of the U-shaped levers 18, 19, and 20. After the three containers are appropriately filled, the lid 4 is placed over the top of the dispensing unit 2 and the bracket 3 with the three sets of ribs 4*d*, 4*e*, and 4*f* on its underside, sealing the upper rims of the three containers (see FIG. 3).

In order to dispense a particular one of the fluid substances, the appropriate dispensing button is pressed downwardly causing the U-shaped lever attached thereto to force the valve spool member 48 downwardly against the urging action of the compression spring 51 in the selected container. Downward motion of the spool member 48 will cause the lower end of the lever arm therein to engage the upper edge of the bifurcated end 49*c* of the valve piece 49, causing downward movement of the piece 49 and the opening of the central partition aperture 44. The fluid substance in the container will have entered the upper chamber 41 of the valve barrel 40 through the slots 47 in its upper portion so that a measured portion of the fluid is contained in the chamber 41 before the operation of the valve. Upon the opening of the central aperture 44 this fluid will be allowed to flow, through the action of gravity and with the assistance of the lower end of the spool member 48 which will act as a piston, into the lower chamber 42 and be directed outwardly through the capillary opening 46 in the end cap 45 fitted on the bottom of the chamber. It will be seen that a selected amount of the fluid substance will be forced through the capillary opening 46 by the downward action of the spool member 48 and the valve piece 49, and particularly by the valve head 49*b* and collar 50, each time the dispensing button is depressed. Leakage of the fluid, remaining in the lower chamber 42 after the dispensing action, through the capillary opening 46 will be prevented by virtue of the surface tension of the fluid as there is no pressure in chamber 42 after collar 50 seals the aperture 44. Also, as there is only one opening in the bottom of the container and the valve levers operate in the upper part of the container, the chance of leakage is minimized. The end cap 45, being press-fitted into the barrel 40, may be readily removed when desired for cleaning the residual fluid from the lower chamber 42 and the cap interior.

It should also be noted that the up and down movement of the valve levers in the containers agitates the fluids therein so that even consistency is promoted and clogging of the valve assembly avoided.

The mirror 5, as shown in FIG. 4, may be disposed in an opening 12*f* in facade member 12 between the lower surface of indented upper edge 12*e* and the upper surface of a rib 12*g* on the inside of member 12. The mirror 5 is held in the opening by strips of tape 55 attached to its upper and lower inner edges and to edge 12*e* and rib 12*g*, respectively. The tape strips 55 assist in absorbing shocks to the mirror during shipping and handling of the dispenser. The front surfaces of the lever arms disposed immediately behind the mirror also act as a non-rigid support for the mirror in the opening.

It will accordingly be appreciated that a fluid dispenser is presented of simplified, leak-resistant construction and operation and with suitable structure for facilitating the wall-mounting of the dispenser on a flat surface or in an irregular corner.

I claim:

1. A dispensing apparatus comprising:

a facade member having an upper peripheral edge;

container means, mounted on said facade member, for retaining a fluid substance to be dispensed and having an open-mouthed top with an upper peripheral edge and an interior rim;

wall-mounting means, having an upper peripheral edge, for mounting said facade member and said container means on a wall;

cover means, extending over said upper peripheral edges, for covering said facade member, said container means and said wall-mounting means and having means on its under side, cooperating with said interior rim, for sealing the top of said container means;

valve means in the bottom of said container means for controlling the dispensing of said fluid substance therefrom;

means for operating said valve means comprising:

a first arm extending substantially vertically into the interior of said container means and connected to said valve means;

a second arm extending substantially vertically between said container means and said facade member;

means for connecting the upper ends of said first and second arms;

means on said second arm, extending through said facade member, for receiving a finger-operated button thereon;

means for urging said valve means in the upward direction; and means defining a slot in the lower portion of said facade member for accommodating said button receiving means in up and down motion, the upper edge of said slot limiting the upward motion of said button receiving means.

2. Apparatus as in claim 1 wherein said container means further comprises means, extending outwardly from its upper peripheral edge and engaging the upper peripheral edges of said facade member and said wall-mounting means, for mounting said container means thereon.

3. Apparatus as in claim 1 further comprising a mirror mounted on said facade member.

4. Apparatus as in claim 1 wherein said cover means comprises a flat upper surface and an upstanding peripheral rim having an opening therein, and said wall-mounting means comprises a flat rear surface means for engaging a flat wall surface and having a vertical recess therein cooperating with said opening to permit the flow of fluid from said flat upper surface between said wall-mounting means and said engaged flat wall surface.

5. Dispensing apparatus comprising:

(a) container means for retaining therein a fluid substance to be dispensed, said container means comprising:

means for defining a first chamber for receiving said fluid substance therein;

means extending into and connected to said first chamber for defining a second chamber and having means for defining a first opening for communicating said fluid substance between said first and second chambers; and means connected to said second chamber for defining a third chamber and having means for defining a second opening for comminicating said fluid substance between said second chamber and said third chamber and means for defining a third opening for dispensing said fluid substance;

(b) piston means for driving said fluid substance between said second and third chambers comprising:

a lower end disposed in said second chamber and movable from a retracted position in said second chamber to a position past said first opening for interrupting communication of said fluid substance between said first and second chambers and forcing the fluid substance in said second chamber through said second opening into said third chamber;

(c) valve means disposed in said third chamber and connected to said lower end for sealing said second opening when said lower end is in said retracted position and opening said second opening when said head means is moved to permit the passage of said fluid substance therethrough;

(d) spring means in said first chamber for urging said lower end to said retracted position; and (e) means for moving said piston means against the urging action of said spring means to force the fluid substance from said secnd chamber into said third chamber for the dispensing thereof through said third opening.

6. Apparatus as in claim 5 wherein said second and third chamber defining means comprise cooperating annular walls forming a cylindrical member extending through a wall of said first chamber defining means; said first opening defining means comprises an aperture in the portion of said cylindrical member within said first chamber; said second opening defining means comprises a partition means in the interior of said cylindrical member for separating said second and third chambers and having an axial aperture therein; and said third opening defining means comprises an end cap, disposed in the end of said cylindrical member outside of said first chamber, having a capillary aperture therein.

7. Apparatus as in claim 6 wherein said lower end comprises an element fitted for movement within said portion of said cylindrical member within said first chamber and having a closed end with an axial aperture therein; and said valve means comprises a shaft having a bifurcated end snap-fitted into said head means axial aperture and a sealing washer mounted on the other end of said shaft for engaging said second opening when said lower end is in said retracted position.

* * * * *

UNITED STATES PATENT AND TRADEMARK OFFICE

CERTIFICATE OF CORRECTION

PATENT NO. : 4,159,788

DATED : July 3, 1979

INVENTOR(S) : JOHN S. DOYEL

It is certified that error appears in the above-identified patent and that said Letters Patent are hereby corrected as shown below:

Col. 8, line 15, (Claim 5) "head means" should read --lower end--.

Col. 8, line 42 (Claim 7) "head means" should read --lower end--.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*